US008157614B2

(12) United States Patent
Zhang et al.

(10) Patent No.: US 8,157,614 B2
(45) Date of Patent: Apr. 17, 2012

(54) METHOD OF MAKING AND APPARATUS HAVING WINDOWLESS POLISHING PAD AND PROTECTED FIBER

(75) Inventors: Jimin Zhang, San Jose, CA (US); Alain Duboust, Sunnyvale, CA (US); Doyle E. Bennett, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 533 days.

(21) Appl. No.: 12/433,256

(22) Filed: Apr. 30, 2009

(65) Prior Publication Data

US 2010/0279585 A1 Nov. 4, 2010

(51) Int. Cl.
*B24B 49/00* (2012.01)

(52) U.S. Cl. ..... 451/6; 451/5; 451/285; 451/41

(58) Field of Classification Search ..... 451/6, 41, 451/285–289; 356/450–521
See application file for complete search history.

(56) References Cited

U.S. PATENT DOCUMENTS

| | | | | |
|---|---|---|---|---|
| 6,454,630 | B1 * | 9/2002 | Tolles | 451/6 |
| 6,916,225 | B2 * | 7/2005 | Sugiyama et al. | 451/6 |
| 7,169,016 | B2 | 1/2007 | Barada et al. | |
| 7,195,539 | B2 * | 3/2007 | Turner et al. | 451/6 |
| 7,214,122 | B2 | 5/2007 | Hirokawa et al. | |
| 7,241,202 | B2 * | 7/2007 | Kobayashi et al. | 451/6 |
| 7,252,575 | B2 * | 8/2007 | Kobayashi et al. | 451/6 |
| 7,255,629 | B2 * | 8/2007 | Birang et al. | 451/6 |
| 7,359,069 | B2 * | 4/2008 | Tanaka et al. | 356/630 |
| 7,442,111 | B2 * | 10/2008 | Lim et al. | 451/6 |
| 7,479,206 | B2 * | 1/2009 | Elledge | 156/345.2 |
| 7,967,661 | B2 * | 6/2011 | Taylor et al. | 451/6 |
| 2003/0114076 | A1 * | 6/2003 | Chang et al. | 451/6 |
| 2003/0171081 | A1 * | 9/2003 | Komukai et al. | 451/285 |
| 2004/0082271 | A1 * | 4/2004 | Wiswesser et al. | 451/6 |
| 2005/0064802 | A1 * | 3/2005 | Wiswesser et al. | 451/285 |
| 2005/0170751 | A1 * | 8/2005 | Birang et al. | 451/6 |
| 2007/0042675 | A1 | 2/2007 | Benvegnu et al. | |
| 2009/0042480 | A1 * | 2/2009 | Shiro et al. | 451/6 |
| 2010/0015889 | A1 * | 1/2010 | Shimizu et al. | 451/5 |

FOREIGN PATENT DOCUMENTS

| | | |
|---|---|---|
| KR | 10-2004-0108008 | 12/2004 |
| WO | WO 2009/008594 | 1/2009 |

OTHER PUBLICATIONS

International search report and written opinion for PCT/US2010/032607 dated Dec. 13, 2010, 8 pages.

* cited by examiner

*Primary Examiner* — George Nguyen
(74) *Attorney, Agent, or Firm* — Fish & Richardson P.C.

(57) ABSTRACT

A polishing system includes a polishing pad with an aperture that extends through all layers of the polishing pad and a light transmissive film positioned on top of a light-generating or light-guiding element of an optical monitoring system.

21 Claims, 2 Drawing Sheets

METHOD OF MAKING AND APPARATUS HAVING WINDOWLESS POLISHING PAD AND PROTECTED FIBER

BACKGROUND

This disclosure generally relates to polishing pads with a window, systems containing such polishing pads, and processes for making and using such polishing pads.

The process of fabricating modern semiconductor integrated circuits (IC) often involves forming various material layers and structures over previously formed layers and structures. However, the underlying features can leave the top surface topography of an in-process substrate highly irregular, with bumps, areas of unequal elevation, troughs, trenches, and/or other surface irregularities. These irregularities can cause problems in the photolithographic process. Consequently, it can be desirable to effect some type of planarization of the substrate.

One method for achieving semiconductor substrate planarization or topography removal is chemical mechanical polishing (CMP). A conventional chemical mechanical polishing (CMP) process involves pressing a substrate against a rotating polishing pad in the presence of slurry, such as abrasive slurry.

In general, it is desirable to detect when the desired surface planarity or layer thickness has been reached and/or when an underlying layer has been exposed in order to determine whether to stop polishing. Several techniques have been developed for the in situ detection of endpoints during the CMP process. For example, an optical monitoring system for in situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad in order to protect the light source and/or the detector from the slurry.

SUMMARY

In general, in one aspect, a polishing system includes a polishing pad, a platen and a light source. The polishing pad has a polishing surface and a bottom surface, and a first aperture is formed in the polishing pad that extends through the polishing pad from the polishing surface to the bottom surface. The platen has a top surface, and the top surface of the platen is positioned below the bottom surface of the polishing pad. The light source is positioned within a second aperture formed in the top surface of the platen, and the first aperture is aligned with the second aperture. A light-transmissive film is positioned on the light source to protect the light source from leakage of material from the polishing surface.

Implementations may include one or more of the following features. The light-transmissive film may be substantially smaller than both the platen surface and the bottom surface of the polishing pad. The light-transmissive film may be positioned between the bottom surface of the polishing pad and the platen surface. The light-transmissive film may cover less than all of the second aperture. The light-transmissive film may be smaller than the second aperture. The light-transmissive film may be attached to the light source, e.g., using a pressure-sensitive adhesive. The polishing system may include a light detector. The light detector may monitor a polishing operation by detecting change in reflectivity of a substrate being polished using the polishing pad. The polishing pad may include an adhesive layer.

In another aspect, a polishing system includes a platen having a top surface to support a polishing pad and an aperture in the top surface, a light-generating or light-guiding element positioned within the aperture in the top surface of the platen, and a light-transmissive film positioned in the aperture on the light-generating or light-guiding element to protect the light-generating or light-guiding element from leakage of liquid from a polishing surface of the polishing pad, wherein the film fits into the aperture without contacting the sides of the platen.

Implementations may include one or more of the following features. A polishing pad having the polishing surface and a bottom surface may be supported on the platen, and a second aperture may be formed in the polishing pad extending through the polishing pad from the polishing surface to the bottom surface, and the second aperture may be aligned with the aperture in the top surface of the platen. The light-transmissive film may be smaller than the second aperture. The light-transmissive film may cover less than all of the aperture. The light-transmissive film may be attached, e.g., using a pressure-sensitive adhesive, to the light-generating or light-guiding element. The light-generating element may be an incandescent element or a light-emitting diode. The light-guiding element may be an optical fiber. The optical fiber may be a bifurcated optical fiber, and the light-transmissive film may be secured to the trunk of the optical fiber.

In another aspect, a polishing system includes a platen having a first aperture, a polishing pad supported on the platen, the polishing pad having a polishing surface and a bottom surface, wherein a second aperture formed in the polishing pad extends through the polishing pad from the polishing surface to the bottom surface, a light-generating or light-guiding element positioned within the first aperture, and a light-transmissive film positioned on the light-generating or light-guiding element to protect the light-generating or light-guiding element from leakage of liquid from the polishing surface, wherein the film fits into the first aperture or the second aperture without contacting the sides of the platen or polishing pad, respectively.

Implementations may include one or more of the following features. The film may fit into the first aperture contacting the sides of the platen. The film may fit into the second aperture without contacting the sides of the polishing pad. The light-transmissive film may be attached, e.g., using a pressure-sensitive adhesive, to the light-generating or light-guiding element. The light-generating element may be an incandescent element or a light-emitting diode. The light-guiding element may be an optical fiber. The optical fiber may be a bifurcated optical fiber, and the light-transmissive film may be secured to the trunk of the optical fiber.

Advantages of embodiments of the invention may include one or more of the following. Elements of an optical monitoring system in the platen, e.g., the optical fiber or other light source, can be protected from slurry. The window in the polishing pad can be a simple open aperture, which typically can results in reduced manufacturing costs.

The details of one or more implementations are set forth in the accompanying drawings and the description below. Other features and advantages will be apparent from the description and drawings, and from the claims.

DETAILED DESCRIPTION

In some CMP systems, the polishing pad is very thin and flexible, so it is difficult to form a window in the polishing pad. Furthermore, providing a window in the polishing pad typically results in increased costs from manufacturing the polishing pad. Therefore, one technique is to place a light-transmissive film positioned over certain elements of the optical monitoring system that are in the platen, e.g., the optical fiber, to protect them from leakage of slurry from the polishing surface.

Figure 1:
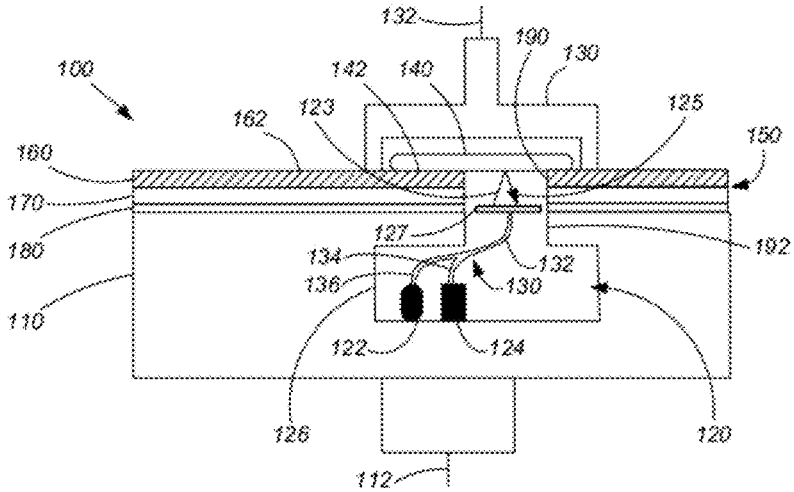
FIG. 1 is a schematic cross-sectional view of a chemical mechanical polishing apparatus containing a polishing pad.

As shown in FIG. 1, a chemical mechanical polishing apparatus 100 includes a polishing head 114 for holding a substrate 140 (e.g., a semiconductor wafer, optionally coated with one or more dielectric, conductive or semiconductive layers).

In addition, polishing apparatus 100 includes a polishing pad 150 disposed on a platen 110. An optical monitoring system 120 includes a light source 122 (e.g., a white light source, a laser, such as a red laser, a blue laser, or an infrared laser, or a light emitting diode, such as a red light emitting diode, a blue light emitting diode, or an infrared light emitting diode) and a light detector 124 (e.g., a photodetector) housed in a recess 126 in platen 110. Optical monitoring system 120 monitors polishing of substrate 140 through an aperture 190 in the polishing pad 150 that is aligned with an aperture 192 in the platen.

A bifurcated optical cable 130 can be used to transmit the light from the light source 122 to the apertures 190, 192, and back from the apertures 190, 192 to the light detector 124. The bifurcated optical cable 130 can include a "trunk" 132 positioned adjacent the apertures 190, 192 and two "branches" 134, 136 connected to the light source 122 and light detector 124, respectively.

In general, during use of apparatus 100 in a CMP process, a chemical polishing solution (e.g., a slurry containing one or more chemical agents and optionally abrasive particles) is applied to polishing surface 162 of covering layer 160 of polishing pad 150. The chemical polishing solution is applied to polishing surface 162 as platen 110, polishing pad 150, and elements of the optical monitoring system 120 in the platen 110 rotate about an axis 112. Polishing head 114 is lowered so that a surface 142 of substrate 140 comes into contact with slurry/polishing surface 162, and polishing head 114 and substrate 140 are rotated about an axis 132 and translate laterally across the polishing pad. Light source 122 directs light beam 123 at surface 142, and light detector 124 measures the light beam 125 that is reflected from substrate 142 (e.g., from surface 142 and/or the surface of one or more underlying layers in substrate 142).

A light-transmissive film 127 protects the optical components of the optical monitoring system 122 from coming into contact with the slurry. For example, the light transmissive film 127 can be positioned on the trunk end of the optical fiber 130, e.g., in a plane parallel to the top surface of the optical fiber, to prevent the slurry from contacting the end of the fiber 130.

The wavelength(s) of light in beam 123 and/or 125 can vary depending upon the property being detected. As an example, the wavelength(s) of interest can span the visible spectrum (e.g., from about 400 nm to about 800 nm). As another example, the wavelength(s) of interest can be within a certain portion of the visible spectrum (e.g., from about 400 nm to about 450 nm, from about 650 nm to about 800 nm). As an additional example, the wavelength(s) of interest may be outside the visible portion of the spectrum (e.g., ultraviolet (such as from about 300 nm to about 400 nm) or infrared (such as from about 800 nm to about 1550 nm)).

The information collected by detector 124 is processed to determine whether the polishing endpoint has been reached. For example, a computer (not shown) can receive the measured light intensity from detector 124 and use it to determine the polishing endpoint (e.g., by detecting a sudden change in the reflectivity of substrate 142 that indicates the exposure of a new layer, by calculating the thickness removed from the outer layer (such as a transparent oxide layer) of substrate 142 using interferometric principles, and/or by monitoring the signal for predetermined endpoint criteria).

Polishing pad 150 can be suitable for polishing silicon or silicon-on-insulator ("SOI") substrates. Polishing pad 150 can include a compressible or "soft" polishing layer.

Figures 2, 3, 4:
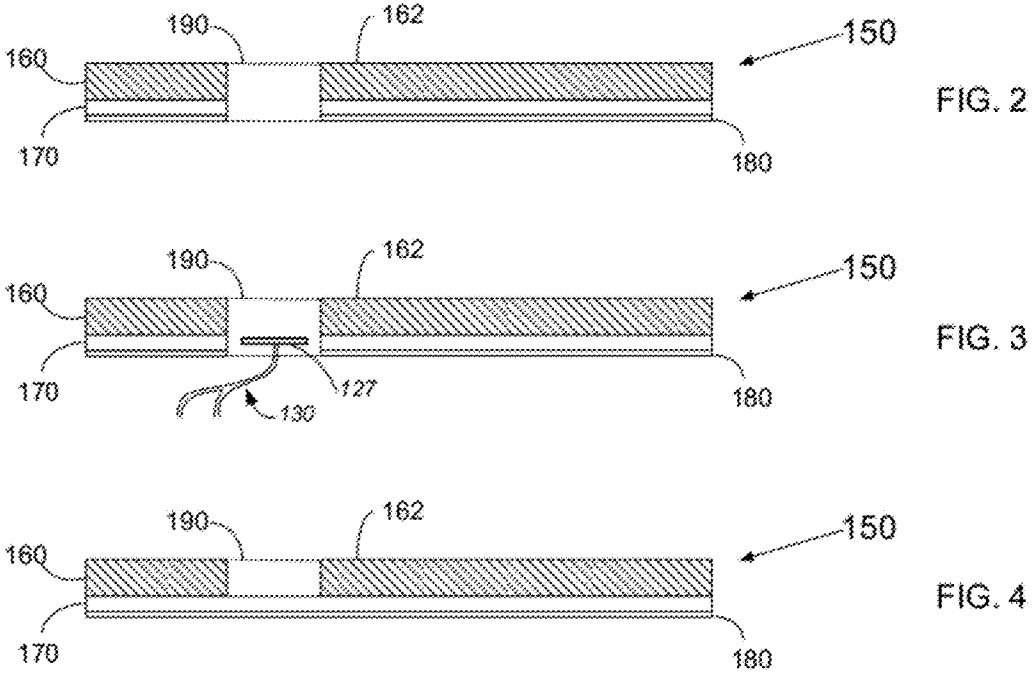
FIG. 2 is a schematic cross-sectional view of a polishing pad with a hole.
FIG. 3 is a schematic cross-sectional view of an optical fiber of an optical monitoring system projecting into a hole in a polishing pad.
FIG. 4 is a cross-sectional view of a polishing pad with a support layer spanning an aperture in the polishing layer.

As shown in FIG. 2, polishing pad 150 includes a polishing layer 160, a supporting layer 170, and an adhesive layer 180. Polishing layer 160 can include a compressible material, such as a polymeric foam, and has a polishing surface 162. An opening 190 extends through polishing pad 150 so that when the polishing pad 150 is disposed on platen 110, the opening 190 in the polishing pad overlies the opening 192 in the platen to the recess 126.

The polishing layer 160 can be attached to the supporting layer 170 by an adhesive layer, such as a layer of pressure sensitive adhesive ("PSA"). Alternatively, the polishing layer 160 can be grown on the supporting layer 170 so that a PSA layer is not needed between the supporting layer 170 and polishing layer 160. For example, a polymer layer can be grown on supporting layer 170 to form the polishing layer 160.

Light-transmissive film 127 is disposed on top of a light-generating or light-guiding optical component of the optical monitoring system 122 to prevent contact with the slurry. Examples of light-generating optical components include incandescent bulbs, fluorescent bulbs, and light emitting diodes. Examples of light-guiding optical components include optical fibers and rectangular waveguides. For example, the light transmissive film can be supported on the end of the optical fiber. The film 127 can overhang the optical component on all sides, e.g., the film can have lateral dimensions (parallel to the polishing pad surface) larger than the corresponding dimensions of the trunk 132 of the optical fiber, and the optical fiber 130 can contact the film 127 in about the center of the film 127. Film 127 can be secured to the optical component by an adhesive, such as PSA.

As shown in FIGS. 1 and 3, the optical components of the optical monitoring system 122, e.g., the optical fiber 130, projects above the top surface of the platen and partially into the hole 190 in the polishing pad 150. Thus, the film 127 can be positioned in the hole 190 in the polishing pad 150. Alternatively, the top of the optical fiber 130 could end below the top surface of the platen, and thus the film 127 could be positioned in the aperture 192 in the platen and entirely below the polishing pad 150. The film 127 can fit in the hole 190 or aperture 192 without contacting the sides of the polishing pad 150 or platen, e.g., the film can have lateral dimensions smaller than the corresponding dimensions of the hole 190 or aperture 192 in which the film is placed.

Film 127 can be formed of one or more polymeric materials, such as, polyethylene terephthalate ("PET") or Mylar®, a polyurethane or a halogenated polymer (e.g., polychlorotrifluoroethylene (PCTFE), perfluoroalkoxy (PFA), fluorinated ethylene propylene (FEP), or polytetra-fluoroethylene (PTFE)).

In certain implementations, the material from which film 127 is made is relatively resistant to the conditions to which it is exposed during the CMP process. The material from which film 127 is made can be relatively chemically inert to the slurry and substrate material. In addition, the window can be relatively resistant to scratching and/or abrasion caused by the slurry (e.g., containing one or more chemical agents and optionally abrasive particles) the substrate, or the pad conditioner.

In some implementations, the material from which film 127 is made is substantially transparent to energy in the range of wavelength(s) of interest.

In certain implementations, the material from which film 127 is made has a relatively low refractive index. For example, the material from which film 127 is made can have a refractive index of about 1.48 or less (e.g., about 1.45 or less, about 1.4 or less, about 1.35 or less, about the same as the refractive index of water). Without wishing to be bound by theory, it is believed that using a material having a relatively low refractive index can reduce reflections from the surface of film 127 (e.g., an interface of air, water (slurry) and film 127) and improve transmission of energy having the wavelength(s) of interest, which is believed to improve the signal to noise ratio of the data collected in the CMP process.

The material from which film 127 is formed can be hydrophilic or hydrophobic. A hydrophilic material can help ensure that there is a layer of slurry or water between the substrate and the window. The presence of the layer of slurry or water prevents the creation of an interface which can cause significant signal distortion. Although some polymer materials tend to be hydrophobic, they can be changed from hydrophobic to hydrophilic using surface treatments, such as roughening or etching. However, for certain applications it may be useful for film 127 to be formed of a relatively hydrophobic window. For example, if a substrate being polished has a hydrophilic layer (SiO2, Si3N4, etc.) on top of hydrophobic layer (Poly Silicon, single crystal Silicon, etc.), then the tendency of the substrate to repel water will increase as the hydrophilic layer is polished away. This transition can be detectable by monitoring the intensity signal from the detector.

As shown in FIG. 2, an aperture 190 extends through all layers of the polishing pad 150 to allow an optical monitoring system to monitor the substrate. However, as shown in FIG. 4, in some polishing pads, support layer 170 remains without an opening. Support layer 170 is formed from a transparent material to allow monitoring of polishing progress through the material. Thus, chemical polishing solution will not be able to leak through an opening and onto the optical monitoring system 120. In the case where support layer material 170 remains without an opening, application of film 127 may not be necessary to protect light source 122 from the slurry.

The supporting member 170 can be formed of an incompressible and fluid-impermeable polymer. For example, supporting material 170 can be formed of polyethylene terephthalate ("PET") or Mylar®.

The adhesive layer 180 can be formed from a PSA. In the case where the aperture 190 extends through all layers of the polishing pad 150, the PSA used in forming the polishing pad can be a material that is not transparent, such as a PSA that is yellow in color. A typical yellow PSA diffuses and absorbs light. For example, for a 670 nm beam, about 10% of the initial intensity ("$I_0$") may pass through the adhesive layer 180, while for a 405 nm beam, less than 2% of the $I_0$ may pass through the adhesive layer 180. Since the beam 123, 125 from the optical monitoring system needs to pass through the adhesive layer 180 twice, the resulting intensity seen by the detector 124 may be less than 1% $I_0$ for the 670 nm beam and less than 0.04% $I_0$ for the 405 nm beam. Thus, intensity scattered back from the adhesive layer 180 into the detector may be larger than the signal 125 from the substrate.

Various implementations have been described. Nevertheless, it will be understood that various modifications may be made without departing from the spirit and scope of the disclosure. In one example, polishing head 114 and semiconductor substrate 140 can translate during operation of apparatus 100. In general, light source 122 and light detector 124 are positioned such that they have a view of substrate 140 during a portion of the rotation of platen 110, regardless of the translational position of head 114. As a further example, optical monitoring system 120 can be a stationary system located below platen 110. A light source, e.g., an LED, could be positioned in the recess 126 to direct light onto the substrate without use of an optical fiber, and the film 127 could be attached to the light source.

As another example, the polishing layer can be a durable microporous polyurethane layer, a fibrous layer, a fixed-abrasive layer, or some other sort of layer. As an additional example, the support layer 170 may be located so that it spans the aperture 190 but does no extend across the entire polishing pad width. As still another example, the support layer 170 may be light-transmitting only in a portion spanning the aperture 190, and the remainder of the support layer 170 may be a different material that is not light-transmitting.

Accordingly, other implementations are within the scope of the following claims.

What is claimed is:

1. A polishing system, comprising:

a platen having a top surface to support a polishing pad and an aperture in the top surface;

a light-generating or light-guiding element positioned within the aperture in the top surface of the platen; and a light-transmissive film positioned in the aperture on the light-generating or light-guiding element to protect the light-generating or light-guiding element from leakage of liquid from a polishing surface of the polishing pad, wherein the film fits into the aperture without contacting the sides of the platen.

2. The polishing system of claim 1, further comprising the polishing pad supported on the platen, the polishing pad having the polishing surface and a bottom surface, wherein a second aperture formed in the polishing pad extends through the polishing pad from the polishing surface to the bottom surface and the second aperture is aligned with the aperture in the top surface of the platen.

3. The polishing system of claim 2, wherein the light-transmissive film is smaller than the second aperture.

4. The polishing system of claim 1, wherein the light-transmissive film covers less than all of the aperture.

5. The polishing system of claim 2, wherein the light-transmissive film is attached to the light-generating or light-guiding element.

6. The polishing system of claim 5, wherein the light-transmissive film is attached to the light-generating or light-guiding element using a pressure-sensitive adhesive.

7. The polishing system of claim 1, wherein the light-generating or light-guiding element comprises a light-generating element.

8. The polishing system of claim 7, wherein the light-generating element comprises an incandescent element or a light-emitting diode.

9. The polishing system of claim 1, wherein the light-generating or light-guiding element comprises a light-guiding element.

10. The polishing system of claim 9, wherein the light-guiding element comprises an optical fiber.

11. The polishing system of claim 10, wherein the optical fiber comprises a bifurcated optical fiber, and the light-transmissive film is secured to the trunk of the optical fiber.

12. A polishing system, comprising:

a platen having a first aperture;

a polishing pad supported on the platen, the polishing pad having a polishing surface and a bottom surface, wherein a second aperture formed in the polishing pad extends through the polishing pad from the polishing surface to the bottom surface;

a light-generating or light-guiding element positioned within the first aperture; and a light-transmissive film positioned on the light-generating or light-guiding element to protect the light-generating or light-guiding element from leakage of liquid from the polishing surface, wherein the film fits into the first aperture or the second aperture without contacting the sides of the platen or polishing pad, respectively.

13. The polishing system of claim 12, wherein the film fits into the first aperture contacting the sides of the platen.

14. The polishing system of claim 12, wherein the film fits into the second aperture without contacting the sides of the polishing pad.

15. The polishing system of claim 12, wherein the light-transmissive film is attached to the light-generating or light-guiding element.

16. The polishing system of claim 15, wherein the light-transmissive film is attached to the light-generating or light-guiding element using a pressure-sensitive adhesive.

17. The polishing system of claim 12, wherein the light-generating or light-guiding element comprises a light-generating element.

18. The polishing system of claim 17, wherein the light-generating element comprises an incandescent element or a light-emitting diode.

19. The polishing system of claim 12, wherein the light-generating or light-guiding element comprises a light-guiding element.

20. The polishing system of claim 19, wherein the light-guiding element comprises an optical fiber.

21. The polishing system of claim 20, wherein the optical fiber comprises a bifurcated optical fiber, and the light-transmissive film is secured to the trunk of the optical fiber.

* * * * *